United States Patent [19]

Hickok

[11] 4,233,543

[45] Nov. 11, 1980

[54] INTERNAL SHUNT FOR SERIES CONNECTED LAMPS

[75] Inventor: Robert L. Hickok, Richmond Heights, Ohio

[73] Assignee: General Electric Company, Schenectady, N.Y.

[21] Appl. No.: 859,056

[22] Filed: Dec. 9, 1977

[51] Int. Cl.[3] ..... H01K 1/70

[52] U.S. Cl. ..... 315/75; 313/315; 362/251

[58] Field of Search ..... 315/65, 64, 69, 46, 315/47, 74–75; 362/251; 313/315

[56] References Cited

U.S. PATENT DOCUMENTS

| | | | |
|---|---|---|---|
| 2,367,905 | 1/1945 | Van Horn | 315/75 |
| 2,605,446 | 7/1952 | Cartun | 315/69 |
| 3,458,756 | 12/1978 | Kotsch | 315/64 |

FOREIGN PATENT DOCUMENTS

| | | | |
|---|---|---|---|
| 4922 | of 1909 | United Kingdom | 315/65 |
| 605649 | 7/1948 | United Kingdom | 315/75 |

*Primary Examiner*—Samuel W. Engle
*Assistant Examiner*—Edward F. Miles
*Attorney, Agent, or Firm*—Norman C. Fulmer; Lawrence R. Kempton; Philip L. Schlamp

[57] ABSTRACT

An improved shunt for series connected lamps is disclosed in which two strips of anodized aluminum foil are fastened together around the inner lead wires of the lamp.

19 Claims, 3 Drawing Figures

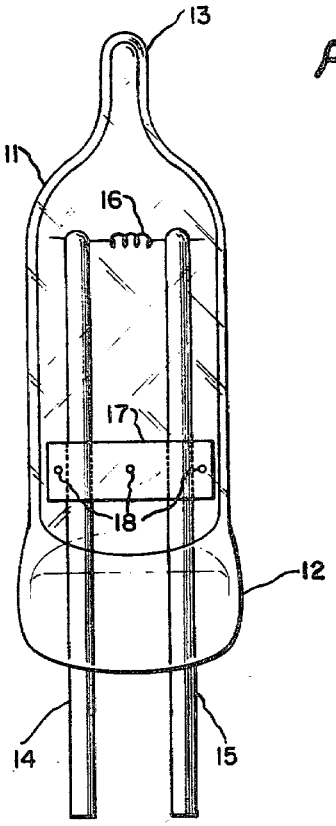
Fig.1
Fig.2
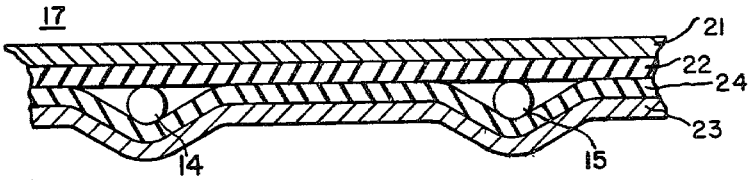

11
35
17
33
34
31

INTERNAL SHUNT FOR SERIES CONNECTED LAMPS

This invention relates to lamps to be used in a series circuit, such as decorative string sets to be used to festoon a Christmas tree, and, in particular, to an internal shunt for use in series connected, subminiature lamp, integral string sets.

Over the last several decades, a variety of types of string sets have been introduced for decorating Christmas trees and other areas of the home during holidays. The use of subminiature lamps for this purpose introduced physical limits on the size of the filament that could be used within the lamp. To prevent the bulb temperature from becoming excessive, a low power lamp is required. However, a low power, 110 volt filament is physically long, too long to be easily used within the subminiature bulb, even if the filament were coiled. The solution to the problem is to use low voltage, low power filaments. While a voltage reducing transformer can be and has been utilized, the lower cost solution to the problem of using low voltage lamps on a 110 volt supply is to series connect the filaments. Thus, the required voltage for this string is the sum of the voltage ratings of the individual lamps. Thus sum can easily be made equal to the household supply voltage.

From the viewpoint of the consumer, the original string sets using subminiature lamps had a serious drawback in that if one lamp "burned out" the entire string went out, making it difficult to find the expired lamp. Providing an internal shunt for the filament cured this problem.

The internal shunt generally comprises one to three turns of fine, anodized (oxide covered) aluminum wire wound, usually by hand, about the inner lead wires of the lamp. The oxide acts as an insulator. As with any insulator, there is a voltage, actually an electric field intensity, at which the oxide breaks down, called the breakdown voltage, which is roughly proportional to oxide thickness. In use, assuming the filaments of all the lamps in the string set are intact, the voltage on the shunt is approximately the nominal voltage of the lamp, eg. six volts for twenty lamp string. If a filament should open, then the full supply voltage is on the shunt. In theory, the shunt is designed so that the breakdown voltage of the oxide is lower than the supply voltage. In practice, the design breakdown voltage is nominal, ie. there are variations in breakdown voltage from lamp to lamp due to the manufacturing process.

Replaceable lamp string sets have an advantage in that if a shunt should malfunction, ie. close when the filament is still intact, the lamp can be replaced. Thus, wide variations in breakdown voltage can be tolerated and a relatively inexpensive shunt can be used thereby keeping down the price of the string set.

For integral string sets, in which the lamps are permanently connected to the conductors, wide variation in breakdown voltage is undesirable since the lamps cannot be replaced. Wire wrapped shunts do not lend themselves to the closer tolerances desired for integral string sets, particularly where it is desired to manufacture the lamps on automatic equipment. In addition, any shunt curing the problem, as with the remainder of the string set, must be capable of being manufactured on automatic equipment to keep costs low.

In view of the foregoing, it is therefore an object of the present invention to provide an improved internal shunt for series connected lamps.

Another object of the present invention is to provide an improved shunt for series connected lamps in an integral string set.

A further object of the present invention is to provide a shunt for an integral string set which can be manufactured automatically.

The foregoing objects are achieved in the present invention wherein two strips of anodized aluminum foil are bonded together around the lead wires of the lamp. Depending upon the thickness of the foil, an added advantage is obtainable from the present invention in that the glass bead, formerly used to support and locate the inner lead wires, can be eliminated.

A more complete understanding of the present invention can be obtained by considering the followin detailed description in conjunction with the accompanying drawings, in which:

FIG. 1 illustrates a lamp in accordance with the present invention.

FIG. 2 illustrates an end view of the shunt in accordance with the present invention.

Figure 3:
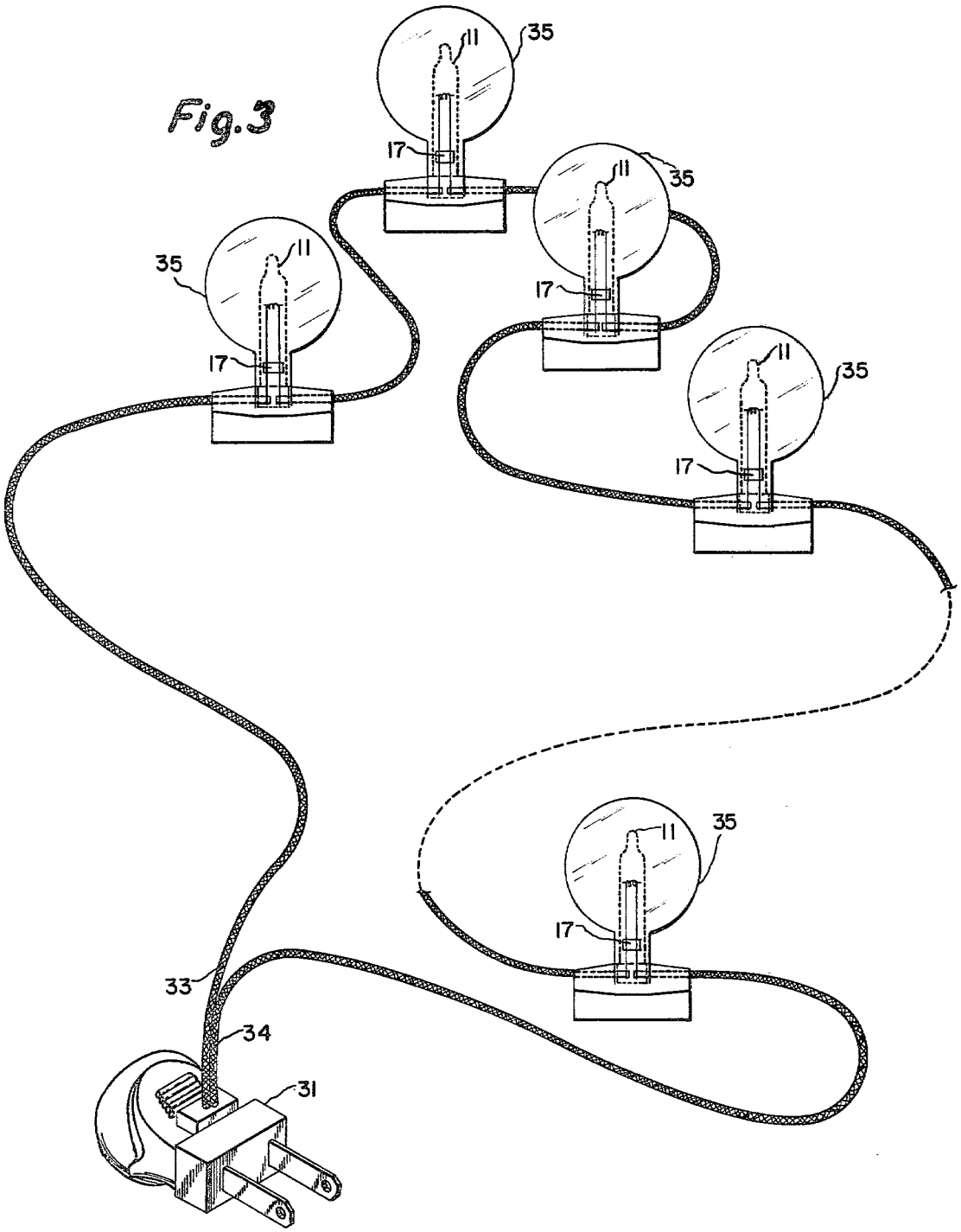
FIG. 3 illustrates an integral string set in accordance with the present invention.

FIG. 1 illustrates a wire lamp having a shunt in accordance with the present invention. As known in the art, a wire lamp simply comprises a lamp manufactured to the point where the envelope is sealed but no base or fastening means is provided. Specifically, the lamp comprises a vitrious envelope 11 having a seal area 12 and an exhaust tip residue 13. Lead wires 14 and 15 are enclosed in seal area 12 and connect filament 16 to the outside world. Shunt 17 in accordance with the present invention comprises a pair of strips of anodized aluminum foil positioned transversely to the lead wires and fastened together, for example, by welds 18. The particular combination of anodized aluminum foil and lead wires is such that the foil is fastened to itself and not to the lead wires since such would destroy the oxide layer on the aluminum and destroy the switch effect obtained therefrom. The foil is, however, in mechanical contact with the lead wires substantially over the portion of the lead wire covered by the foil.

FIG. 2 illustrates the configuration of the shunt in an assembled lamp. Specifically, shunt 17 comprises a first strip of aluminum 21 having oxide layer 22 formed thereon. A second strip of aluminum 23 has oxide layer 24 formed thereon. Shunt 17 is assembled with oxide layers 22 and 24 in contact with each other on the inside of the sandwich formed by the two strips of aluminum foil. Strip 23, as illustrated in FIG. 2, is non-planar in that it is deformed slightly to accommodate lead wires 14 and 15. Obviously, either one or both of foils 21 and 23 may be deformed to accommodate the lead wires.

Lead wires 14 and 15 typically comprise borated dumet wire. As known in the art, dumet comprises copper-plated nickel iron alloy wire. Borated dumet has the surface thereof treated so that a cuprous oxide film is formed on the surface of the wire. Cuprous oxide is a semiconducting material whereas cupric oxide is a insulator. While forming no part of the present invention, it is theorized that the cuprous oxide appears to, in effect, repair surface defects in the aluminum oxide insulator on the aluminum foil. This appears to depend somewhat upon the thickness of aluminum oxide. However, for breakdown voltages within the range of 60 to 80 volts, the aluminum oxide thickness is on the order of one-half micron and, at this thickness, the repair effect occurs. Since it appears that these are surface phenomena, other lead wires having a cuprous oxide film on the surface thereof may be utilized, for example, what is known in the art as coppermet.

The aluminum foil itself, ie. elements 21 and 23, may have any suitable thickness, for example, within the range of one to ten mils (25–250 microns). At the lower end of this range, shunt 17 provides only a shunt function and lamp 11 preferably further comprises a glass bead for locating and positioning the lead wires. At the upper end of this range,the lamp is preferably constructed as illustrated in FIG. 1, where the glass bead is eliminated and shunt 17 provides the dual functions of an electrical shunt and a mechanical support.

In making a lamp in accordance with the present invention, the first aluminum strip may conveniently be placed over a die having channels therein spaced according to the lead wire spacing in the finished lamp. The first aluminum strip, if not oxidized on both sides, is placed oxidized side up on the die. The lead wires are then laid over the first strip and are orthogonial thereto and held in position above the channels in the underlying die. The second strip is placed over the lead wires, oxide side down, and the sandwich is pressed together to deform at least one of the aluminum strips so that contact is made by the oxide layers with each other and between the oxide layers and the lead wires. The strips are fastened together by any suitable means such as by ultrasonic probes which serve to disrupt the oxide layer and join aluminum to aluminum.

FIG. 3 illustrates a string set in accordance with the present invention in which a plurality of shunted lamps are series connected in an open loop type of string set. Specifically, plug 31 is connected to conductors 33 and 34 which form a segmented loop having a plurality of lamps 11 joining the segments to form a series circuit. In the circuit, the filament of each lamp is permanently attached to the wires of the string set and the lamp and connections enclosed in a suitable enclosure 35, such as described in copending application Ser. No. 859,940, filed concurrently herewith and assigned to the assignee of the present invention. In operation, should any of the filaments in one of lamps 11 fail, then shunt 17 switches to a low resistance and maintains the remainder of the intact filaments in a lighted condition.

The present invention thus provides a more reliable shunt than the turns of wire type and, at the same time, provides a shunt easily manufactured automatically. Since a shunt in accordance with the present invention is more reliable, an integral string set is commerically attractive.

Having thus described the invention it will be apparent to those of ordinary skill in the art that various modifications can be made within the spirit and scope of the present invention. For example, while described as two separate strips, the shunt may comprise a single, longer strip folded in half about the lead wires.

What I claim as new and desire to secure by U.S. Letters Patent is:

1. An internal shunt for series connected lamps having at least two inner lead wires comprising:

a first flat strip of aluminum foil having an oxide coating on at least one side thereof;

a second strip of aluminum foil having an oxide coating on at least one side thereof and indentations on said at least one side thereof for receiving said lead wires; and said first and second strips in combination surround a portion of both of said wires and are individually positioned approximately parallel to each other on opposite sides of said lead wires, the oxide coating on each strip being in contact with both led wires, and said strips being bonded together adjacent the ends thereof and at a location intermediate said lead wires, and the bonding of the strips being so spaced from said lead wires to thereby avoid damaging said oxide coatings at said lead wires.

2. The internal shunt as set forth in claim 1 wherein at least one of said strips is shaped about a portion of said lead wires.

3. The internal shunt as set forth in claim 2 wherein said strips are each at least one mil thick.

4. The internal shunt as set forth in claim 2 wherein said strips are each within a range of 1–10 mils thick.

5. In a lamp, for series connection with at least one other lamp in an electrical circuit, having a sealed envelope;

a filament contained within said envelope;

a pair of lead wires extending through one end of said envelope and attached to said filament;

the improvement comprising an internal shunt having a first flat strip of aluminum foil having an oxide coating on at least one side thereof;

a second strip of aluminum foil having an oxide coating on at least one side thereof and indentations on said at least one side for receiving said lead wires; and said first and second strips in combination surround a portion of both of said lead wires and are individually positioned approximately parallel to each other on opposite sides of said lead wires, the oxide layer coating on each strip being in contact with both lead wires and said strips being bonded together adjacent the ends thereof and at a location intermediate said lead wires, and the bonding of the strips being so spaced from said lead wires to avoid damaging said oxide coatings in contact with said lead wires.

6. The lamp as set forth in claim 5 wherein said lamp further comprises a vitreous bead within said envelope for positioning said lead wires relative to each other and wherein said strips are each at least one mill thick.

7. The lamp as set forth in claim 5 wherein said strips are within a range of 1–10 mils thick and said strips position said lead wires relative to each other.

8. In an integral string set having a plurality of incandescent lamps series connected in a circuit, each lamp having a filament connected to two lead wires, the improvement comprising a shunt in at least some of said lamps, wherein each shunt comprises:

a first flat strip of aluminum foil having an oxide coating on at least one side thereof;

a second strip of aluminum foil having an oxide coating on at least one side thereof and indentations on said at least one side for receiving said lead wires; and said first and second strips in combination surround a portion of both of said lead wires are individually positioned approximately parallel to each other on opposite sides of said lead wires, the oxide coating on each strip being in contact with both lead wires, and said strips being bonded together adjacent the ends thereof and at a location intermediate said lead wires, and the bonding of the strips being so spaced from said lead wires to avoid damaging said oxide coating in contact with said lead wires.

9. The string set as set forth in claim 8 wherein said strips are each within a range of 1–10 mils thick and said strips position said lead wires relative to each other.

10. The string set as set forth in claim 9 wherein said oxide coating on each strip is on the order of one half micron thick.

11. The string set as set forth in claim 9 wherein said shunts are characterized by a breakdown voltage within the range of 60–80 volts inclusive.

12. The string set as set forth in claim 11 wherein at least one of the strips in each shunt is shaped about a portion of said lead wires.

13. An internal shunt for series-connected lamps having at least two inner lead wires comprising:

a strip of aluminum foil surrounding a portion of both of said lead wires and having an oxide coating on at least one surface thereof and being bent for forming overlapping first and second portions of said strip, said first portion being flat and said second portion having indentations of said oxide coated surface thereof for receiving said lead wires, and wherein said oxidized coating of said first and second portions of said aluminum foil strip are positioned for contacting opposite sides of each of said lead wires, and said first and second positions of said strip being bonded to each other adjacent the end thereof and at a location intermediate said lead wires, and the bonding of the strips being so spaced from said lead wires to avoid damaging said oxide coating in contact with said lead wires.

14. The internal shunt as set forth in claim 13, wherein said strip is within a range of 1–10 mils thick.

15. The internal shunt as set forth in claim 13, wherein said oxide layer is approximately one-half a micron thick.

16. An internal shunt for series-connected lamps having at least two inner lead wires comprising:

a strip of aluminum foil surrounding a portion of both of said lead wires and having an oxide coating on at least one surface thereof and indentations on said oxide coated surface for receiving said lead wires and being formed to surround a portion of both of said lead wires and dispose said oxide layer inwardly of said strip in abutting relation with opposite sides of said lead wires; and said strip being bonded to itself adjacent the end thereof and at a location intermediate said lead wires, and the bonding of the strips being so spaced from said lead wires to make insulative contact between said strip and said lead wires without disturbing the oxide coating on said strip abutting said lead wires.

17. The internal shunt as set forth in claim 16, wherein at least a portion of said strip is shaped about a portion of said lead wires.

18. The internal shunt as set forth in claim 16, wherein said strip has a thickness in the range of 1–10 mils thick.

19. the internal shunt as set forth in claim 16, wherein said oxide coating is approximately one-half a micron thick.

* * * * *